US007509954B2

(12) United States Patent
Schreffler

(10) Patent No.: US 7,509,954 B2
(45) Date of Patent: Mar. 31, 2009

(54) RESIDENTIAL FIREPLACE INSERT

(76) Inventor: Robert Z. Schreffler, 12817 Richmond St., Chester, VA (US) 23831-4749

( * ) Notice: Subject to any disclaimer, the term of this patent is extended or adjusted under 35 U.S.C. 154(b) by 131 days.

(21) Appl. No.: 11/507,343

(22) Filed: Aug. 21, 2006

(65) Prior Publication Data

US 2008/0041361 A1 Feb. 21, 2008

(51) Int. Cl.
*F24B 1/189* (2006.01)

(52) U.S. Cl. ..... 126/522

(58) Field of Classification Search ..... 126/522, 126/523, 521

See application file for complete search history.

(56) References Cited

U.S. PATENT DOCUMENTS 3,001,521 A * 9/1961 Reilly ..... 126/524
4,088,114 A * 5/1978 Johnson ..... 126/522
4,250,867 A * 2/1981 Andersen et al. ..... 126/502
4,252,106 A * 2/1981 Estes ..... 126/502

* cited by examiner

*Primary Examiner*—Kenneth B Rinehart
*Assistant Examiner*—Chuka C Ndubizu

(57) ABSTRACT

This invention relates to a one-piece, self-contained air-heating, slide-in residential fireplace insert system comprising three sections: a control/base section, a front closure system and a tubing system; in particular to a system containing a plurality of individual tubularly confined columns of moving air (under fan pressure) surrounding a heat-radiating source on five sides, (excluding the front closure), where-in the said columns of moving air are heated within the said tubing system by radiation from the said heat-radiating source through the metal walls of the said confined columns of moving air before the said heated air is exited into an attending room. This said slide-in fireplace insert system is designed for burning fossil fuels such as wood, coal, brickettes, wood pellets etc, and can also provide alternative additional electric heat to the said moving columns of heated air by energizing a "Calrod" heating rod configuration fitted into the heated air discharge portion of the said metal air heating tubing system.

1 Claim, 1 Drawing Sheet

Figures 1, 2, 3, 4, 5:
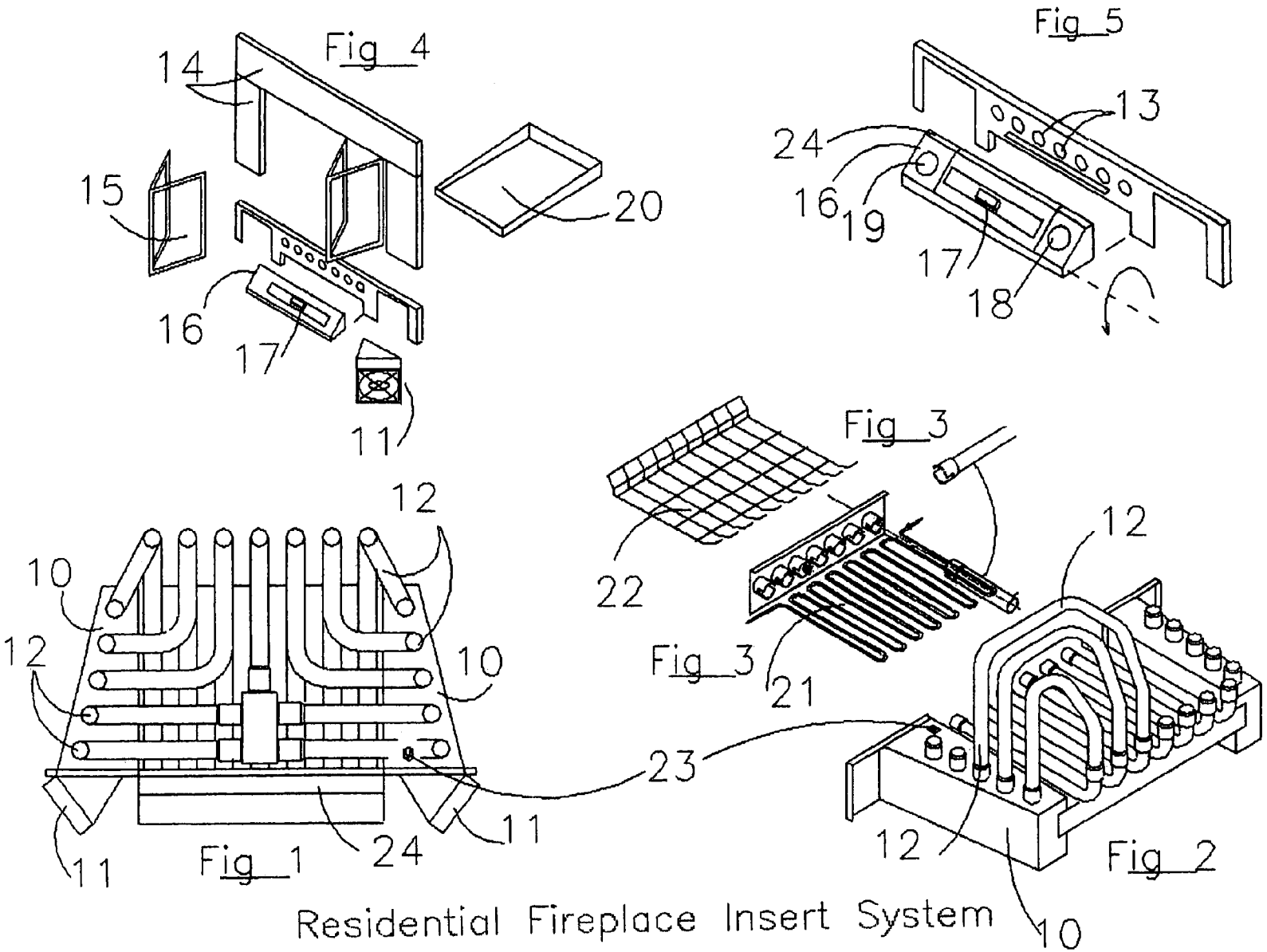

Residential Fireplace Insert System 13
18
17
19
16
24

20
14
15
16
17
11

22
21

12
10
12

12
10
11
24
10
12
11
23
Residential Fireplace Insert System

RESIDENTIAL FIREPLACE INSERT

BACKGROUND OF THE INVENTION

For many years a standard masonry fireplace cavity whether of brick, stone, or other non-flammable materials usually required the standard dimensions of 36" wide, 30" high, 22"deep, and a rear dimension width of 24". Early fireplaces had no "closure" doors and were "open" but would eventually accommodate a screen for fire prevention from flying sparks. Earlier colonial era fireplaces of two centuries ago included a one or two level height of stone or bricks on the hearth floor on each side called "hobs". These hobs provided the several functions of a warming shelf, support to keep logs above the hearth "floor" and a more efficient way to confine and direct the draft of air more efficiently to the burning flame area by "closing-in" the space between the ends of the logs and the fireplace sides. Draft control consisted of minimal or no damper adjustment in order to control heat radiation, and the hobs helped direct draft air more effectively to the combustion flame area. In more modern days a front enclosure was employed utilizing hinged glass doors to allow easier replenishment of fuels for combustion. In recent years we have had a resurgent interest in obtaining better fireplace inserts, many looking like a smaller "Franklin-Type" design, (an iron-sided, heat-radiating, free-standing box with draft control doors).

SUMMARY

My "improvement in the art" relates to a slide-in fireplace insert system placed into a standard residential fireplace opening and intended for burning fossil fuels such as wood, coal, charcoal, brickettes, wood pellets, etc, or related consumables to produce "room heat". The insert system comprises three components: a control/base, a "surround" front closure and a tubing cluster.

1. Control/base—The heart of the insert system, the control/base has two plenum chambers (fixedly attached to the rear of the front control/base panel each with an axial suction fan, each plenum with a plurality of air exit holes on the top surface. The control/base has a central major hinged air draft control door said hinged air draft control also containing two fine-tuning air draft adjustments located thereon and a plurality of air exit holes located above the draft door opening. Also included are the necessary switches, controls and electric power supply cord. It is essential to point out that the ash pan and the grate, while not fixedly attached to the control/base itself are considered vital parts thereof.

At this point it seems prudent to point out that the plenum chambers and hobs are the same physical items the only difference being in function. The hobs were historically of "solid" stone and used to refer to a centuries-old use as an aid to get draft air more efficiently conducted to the flame area, whereas the plenums are asymetric rectangular hollow air chambers used to divide the intake plenum air volume into separate columns of moving air with the aid of its axial air intake fan. The generally parallel "common" side of each of the two plenum chambers not only define the walls of the hobs for air draft supply, but effectively "center" the ash pan between them.

2. Front closure—An important yet most under-developed area of all similar structures to date. Most have bifold doors, some are simple center-opening but all used to the present are most inefficient especially those with thicker (3/16") tempered glass. The "R" factor is bad enough with (1/8") clear tempered glass. In tests done to date the most efficient medium for heat radiation appears to be no glass at all.

3. The Tubing Cluster—the said five-sided box arrangement of pipes (or metal tubings) has one function; to connect the air outlets of the said plenum chambers to the said air exit outlets in the face of the control base and exposing as much as possible of their heat absorbing exterior metal surfaces in each of the five planes to the heat-radiating source in order to provide a maximum heated air volume exiting into the attendant room, the lower plane of tubing embedded within the control/base just beneath the grate.

SUMMARY OF THE INVENTION

My "improvement in the art" relates to a slide-in fireplace insert system placed into a standard residential fireplace opening and intended for burning fossil fuels such as wood, coal, brickettes, charcoal, etc, or related consumables.

The control/base contains two plenum chambers and each with a suction fan pulling air into the said chamber and a plurality of air exiting holes aligned along the top surface. It is through these exiting holes that plenum air is divided into separate generally parallel moving columns of air as they start their collective separate heating journeys, each said moving column of air in its own individual air-confining metal heat-absorbing tubing fixedly attached at each end. The said box structure has an equal number of corresponding air inlet tubes to be fixedly attached to each respective plenum air supply source outlets. From each plenum the air columns progress from the hobs up the right and left sides within the fireplace cavity. The total of the said tubing arrangements make a 90 degree bend to converge toward each other over and above the said heat-radiating source (centered in the fireplace cavity), then the said tubing begin several convergences through 90 degrees toward the rear of the fireplace cavity, down the back of the fireplace cavity, and the said tubing (fixedly attached) to finally converge arriving at the said exit openings in the control front for the said heated air columns to be exited forwardly in a horizontal plane over a fragrance strip into the attendant room between the heat-radiating grate level above, and the ash collector pan level below. When the glowing red hot coals get too small for heat radiation they fall through the mesh openings in the grate and drop into the said ash collector pan beneath. It is important to know that when this said insert is in use any draft control built into the bottom of the chimney flue is no longer needed. All draft is now controlled by the fireplace insert system flue controls on the front of the said control/base. When the said insert is installed and in use, any chimney "built-in" flue controls should be permanently set on "open".

An unexpected benefit is realized when the fire is "low" and few glowing coals are left. Just adding new wood or combustible fuel on top of those glowing coals, and raising the major draft door slightly will divert part of the exiting air flow and redirect that said air flow back through the mesh grate thereby fanning the embers "into life", igniting the newly added fuel.

An optional further improvement in the art also utilizes a specially configured electrical heating rod (eg. "Calrod" or equivalent) formed to be inserted into the said horizontal forwardly disposed air exiting pipes and able to supply heat into the said attendant room even when no flame-type ongoing heat-radiating source through the woven wire mesh grate is utilized.

DESCRIPTION OF THE PREFERRED EMBODIMENT

FIG. 1 is a top view of the fireplace insert system showing the "hobs" or plenum chambers 10, axial fans 11 to draw room air into the said plenum chambers, tubular confining air passages 12, an electrical outlet receptacle 23, (to power an "inside" artificial electric flame display) and a fragrance strip location 24.

FIG. 2 is a right quarter rear view of the slide-in insert base in perspective showing the "hobs" or plenum chambers 10, tubular confining air passages 12, and the said electrical outlet receptacle 23.

FIG. 3 shows the general configuration of the "Calrod" or serpentine electric heater rod design arrangement 21 and its disposition relative to its insertion into the said tubular confining air passage exits as well as the woven wire screen (or metal grate) 22 which rests upon the horizontal said tubular confining air passages 12. The said woven wire screen (or metal grate) shall have rectangular grid openings ranging from 1/16"×1/16" up to 4"×4", or any combination thereof.

FIG. 4 shows an exploded presentation of the exposed room portion of the fireplace insert system controls. Shown are, surround 14 (detatched from the said insert control/base), and surround closure doors 15. fan 11, hinged major damper 16, minor damper adjustment 17, and ash pan 20.

FIG. 5 shows a control/base comprising, a hinged damper 16, minor damper adjustment 17, fan speed control 18, "Calrod" heater rod control 19, fragrance strip location 24, and air outlets 13, where the said heated columns of air exit into the attendant room even when no flame-type ongoing heat radiating source through the woven wire mesh grate is utilized.

The invention claimed is:

1. An improvement in the art related to a slide-in residential wood-burning fireplace insert system designed to fit into a standard fireplace cavity for the purpose of supplying and delivering heated columns of air into an attending room, the said wood-burning fireplace insert system is also able to use coal, wood pellets, charcoal, brickettes, etc. for the purpose of providing red hot coals for a central heat-generating source of radiated heat available to warm a system of pipes or tubings, the said pipes or tubings comprising a five-sided, slide-in box structure (plus front closure, grate and ash pan) encircling the said heat-generating source, the said box structure loosely formed of metal pipes (or tubings) fixedly attached to one or more plenum chambers, the said plenum chambers in turn fixedly attached to a control/base, each said plenum chamber equipped with a suction fan which supplies and divides the incoming air into a plurality of tubing-confined advancing columns of air, to be heated by radiation from the said heat-generating source, the walls of the said pipes or tubings temporarily store radiated heat from the said heat-generating source, the walls of the said metal tubes dispense it in turn by physical contact with the said column of advancing air passing in contact within, under plenum air pressure through the exiting outlet holes provided in the said plenums to which the said metal tubing entrances are fixedly attached, the said tubing-confined advancing columns of air rise up the right and left sides within the said fireplace cavity from the said plenum chambers, each side of said tubing-confined advancing columns of air bend 90 degrees approaching each other near the said cavity top generally centered above the said heat-radiating source, the said tubings immediately bend another 90 degrees to converge in generally parallel column-paths toward the rear of the said fireplace cavity to converge again 90 degrees down the back of the said fireplace cavity, finally to converge 90 degrees once again in parallel fashion to terminate their collective said confined heated advancing air column tubings fixedly attached to the exit holes provided in the face of the said control/base the said heated air passing over the inserted said Calrod heating rod configuration to exit from the said air-confining metal tubings at which point the said heated advancing tubing-confined columns of air are exited into the said attendant room, the said fireplace insert system incorporating all related draft, fan and heat regulating controls, the said hinged damper in a control/base sufficiently large enough to allow removal and re-insertion of an ash pan as well as to provide additional air draft capacity when using hobs "assist" on start-up, a woven wire (or cast iron) grate not fixedly attached to the said control/base because of operational adjustment flexility, cleaning and replacement constraints due to wear and testing parameters.

* * * * *